US012612736B2

(12) United States Patent
Kolari et al.

(10) Patent No.: US 12,612,736 B2
(45) Date of Patent: Apr. 28, 2026

(54) METHOD FOR REDUCING AMOUNT OF BACTERIAL ENDOSPORES IN AN AQUEOUS FIBRE SUSPENSION

(71) Applicant: KEMIRA OYJ, Helsinki (FI)

(72) Inventors: Marko Kolari, Espoo (FI); Juhana Ahola, Espoo (FI)

(73) Assignee: KEMIRA OYJ, Helsinki (FI)

( * ) Notice: Subject to any disclaimer, the term of this patent is extended or adjusted under 35 U.S.C. 154(b) by 407 days.

(21) Appl. No.: 18/038,908

(22) PCT Filed: Nov. 29, 2021

(86) PCT No.: PCT/FI2021/050824

§ 371 (c)(1),
(2) Date: May 25, 2023

(87) PCT Pub. No.: WO2022/112663

PCT Pub. Date: Jun. 2, 2022

(65) Prior Publication Data

US 2024/0018726 A1 Jan. 18, 2024

(30) Foreign Application Priority Data

Nov. 30, 2020 (FI) ..... 20206220

(51) Int. Cl.

| | |
|---|---|
| ***D21H 21/36*** | (2006.01) |
| ***D21C 9/00*** | (2006.01) |
| ***D21H 11/14*** | (2006.01) |
| ***D21H 17/65*** | (2006.01) |

(52) U.S. Cl.

CPC ..... *D21H 21/36* (2013.01); *D21C 9/004* (2013.01); *D21H 11/14* (2013.01); *D21H 17/65* (2013.01)

(58) Field of Classification Search

CPC ..... A01N 47/44; A01N 43/80; D21H 32/36
USPC ..... 162/161
See application file for complete search history.

(56) References Cited

U.S. PATENT DOCUMENTS

| | | | | |
|---|---|---|---|---|
| 3,082,146 | A | 3/1963 | Wentworth et al. | |
| 5,900,111 | A | 5/1999 | Nystroem et al. | |
| 6,391,150 | B1 | 5/2002 | Berger et al. | |
| 2009/0114353 | A1 | 5/2009 | Tachikawa et al. | |
| 2009/0294082 | A1 | 12/2009 | Kolari | |
| 2018/0037936 | A1 | 2/2018 | Riihinen et al. | |
| 2019/0082697 | A1* | 3/2019 | Ahola | A01N 33/04 |
| 2019/0364892 | A1 | 12/2019 | An et al. | |
| 2020/0095730 | A1* | 3/2020 | Ekman | D21H 21/36 |
| 2021/0189646 | A1 | 6/2021 | Ahola et al. | |

FOREIGN PATENT DOCUMENTS

| | | | |
|---|---|---|---|
| CN | 103299990 | A | 9/2013 |
| WO | 2013098478 | A2 | 7/2013 |

OTHER PUBLICATIONS

International Search Report and Written Opinion in Application No. PCT/FI2021/050824, mailed Feb. 23, 2022, 14 pages.
Search Report of Finnish Application No. FI20206220, dated Jun. 3, 2021, 2 pages.
Search Report issued on Oct. 14, 2024, in Chinese Patent Application No. 2021800801224.

* cited by examiner

*Primary Examiner* — Jacob T Minskey
(74) *Attorney, Agent, or Firm* — Meunier Carlin & Curfman LLC

(57) ABSTRACT

The invention relates to a method for reducing bacterial endospores in an aqueous fibre suspension comprising recycled cellulosic fibres, wherein the fibre suspension has an original endospore amount, preferably of ≥10 000 CFU/ml. The method comprises adjusting the pH of the fibre suspension to a pH value of ≤6.5, adjusting the oxidation-reduction potential (ORP) of the fibre suspension to an ORP value of ≥200 mV with a first oxidizing agent, and introducing an amount of performic acid as a second oxidizing agent to the fibre suspension for reducing the bacterial endospores to an endospore amount of ≤1000 CFU/ml.

16 Claims, No Drawings

METHOD FOR REDUCING AMOUNT OF BACTERIAL ENDOSPORES IN AN AQUEOUS FIBRE SUSPENSION

CROSS REFERENCES

This application is a U.S. national stage application of international patent application number PCT/FI2021/050824 filed on Nov. 19, 2021 claiming priority to Finnish national patent application number F120206220, filed on Nov. 30, 2020.

FIELD OF THE INVENTION

The present invention relates to a method for reducing or decreasing amount of bacterial endospores in an aqueous fibre suspension according to the preamble of the enclosed independent claim.

BACKGROUND

Bacterial cells are normally present in the aqueous environments of paper, board and tissue mills. Bacterial growth in the process is commonly monitored and limited by using various measures, e.g. feeding of biocides into the process. However, certain bacterial cells form endospores, which are highly resistant to typical bacterial destruction methods, such as heat, disinfectants, chemical biocides, desiccation, ultraviolet light and ionizing radiation. The bacterial endospores may remain viable but dormant for prolonged periods, even for years, until the external conditions become favourable, after which the transformation, i.e. germination, of bacterial endospores takes place.

Recycled fibre material usually contains high amounts of bacteria as well as bacterial endospores. The fibre material collected from consumers and industrial sources for recycling often contain contamination, such as food or oil residues, which provide good growth medium for bacteria. Even relatively clean looking recycled fibre material, such as collected office waste paper, usually contains high amounts of endospores as the endospore amounts are not actively monitored in production of non-hygiene/non-food packaging paper or board grades. Furthermore, the collected fibre material is often stored baled in dirty, humid and/or warm conditions that increase the risk for extensive bacterial growth. Consequently, fibre suspensions produced from recycled fibre material usually contain high amounts of bacterial contamination in form of bacteria and bacterial endospores.

The high bacterial contamination of the fibre suspensions produced from the recycled fibre material may cause problems in paper and board making process itself, or it may limit the uses of the produced paper or board. For example, if the paper or board product is intended for hygiene purposes or for packaging of food or beverages, the allowable amount of bacterial endospores in the final paper and board product is strictly limited in order to avoid possible contamination of packaged materials. These limitations have caused that the use of recycled fibre material has been practically non-existent in paper and board products that have been intended for food and beverage packaging. On the other hand, due to the constantly increasing demand for sustainability in all industrial production, there is an interest to increase and/or expand the use of recycled fibres in production of all paper and board grades. Consequently, there is a need for effective ways to decrease the amount of bacterial endospores in aqueous fibre suspensions comprising recycled cellulosic fibres.

SUMMARY OF THE INVENTION

An object of this invention is to minimise or possibly even eliminate the disadvantages existing in the prior art.

Another object of the present invention is to provide an effective method for reducing or decreasing the amount of bacterial endospores in aqueous fibre slurries comprising recycled cellulosic fibres.

These objects are attained with the invention having the characteristics presented below in the characterising parts of the independent claims.

Some preferred embodiments of the invention are presented in the dependent claims.

In a typical method according to the present invention for reducing or decreasing amount of bacterial endospores in an aqueous fibre suspension comprising recycled cellulosic fibres, wherein the fibre suspension has an original endospore amount, preferably of ≥10 000 CFU/ml, the method comprises (a) adjusting the pH of the fibre suspension to a pH value of ≤6.5, (b) adjusting the oxidation-reduction potential (ORP) of the fibre suspension to an ORP value of ≥200 mV with a first oxidizing agent, and (c) introducing an amount of performic acid as a second oxidizing agent to the fibre suspension for reducing or decreasing the bacterial endospores to an endospore amount of ≥1000 CFU/ml.

Now it has been surprisingly found that the high bacterial endospore amount in a fibre suspension comprising recycled cellulosic fibres can be effectively reduced when the pH and the oxidation-reduction potential (ORP) of the fibre suspension are first adjusted to the specific values of ≤6.5 pH and ORP ≥200 mV, followed by treatment of the fibre suspension with performic acid. It is assumed that when the performic acid is introduced to the fibre suspension as a second oxidant, at the right pH range and after the adjustment of the ORP value of the suspension with a first oxidant, the endospore destroying performance of the performic acid can be successfully employed, and even excessive endospore amount in the suspension can be significantly decreased with reasonable performic acid consumption. It has been observed that the present method may easily reduce the amount of bacterial endospores in the fibre suspension by 2-4 logarithmic units, possibly even more. The combination of the adjustment of the pH and the ORP value and introduction of the performic acid provided unexpected improvement in endospore control for fibre suspensions comprising recycled fibres and high amount of bacterial endospores. The reduction in bacterial endospore amount enables the use of the treated fibre suspension comprising recycled cellulosic fibres even for production of paper and board grades intended for hygienic purposes and/or for packaging of food or beverages.

DETAILED DESCRIPTION OF THE INVENTION

In the present context the term "oxidation-reduction potential", abbreviated as ORP, refers to the oxidizing or reducing potential of the aqueous fibre suspension. The ORP value for an aqueous fibre suspension may be determined by using a chemically-inert electrode which is immersed in the suspension and measuring its potential relative to a reference electrode. Several commercial sensors for ORP value measurements are available.

In the present context the term "bacterial endospore" is understood as dormant and non-reproductive structure formed by bacteria. Bacterial endospore comprises bacterium's DNA and a part of its cytoplasm encased by a protective outer covering. Bacterial endospores can germinate to the metabolically active state, i.e. vegetative state, under favourable conditions. According to one embodiment of the invention the present method is used to reduce amount of bacterial endospores e.g. from Bacillus, Brevibacillus and/or Paenibacillus, which are known to grow in the process conditions of a paper, board and tissue machines, and the like. These bacterial genera are capable of producing thermotolerant endospores, which are resistant to the heat of the dryer sections employed in processes producing cellulosic fibre webs, such as paper, board, tissue and the like.

All bacterial endospore values CFU/ml, in this context, are given for a fibre suspension having a fibre consistency of 4 weight-%, given as dry fibre. The bacterial endospore value is either determined from a fibre suspension having a fibre consistency of 4 weight-%, or if determined from another consistency, the bacterial endospore value is calculated to correspond the endospore value for fibre consistency of 4 weight-%.

The fibre suspension comprises a liquid phase, which is normally water, and a solid phase which comprises at least recycled cellulosic fibres and optional inorganic particles suspended in the liquid phase. The initial aqueous fibre suspension, which is subjected to bacterial endospore reducing treatment in the method of the present invention, comprises recycled cellulosic fibres and it has an initial bacterial endospore amount of at least 1000 CFU/ml, typically at least 5000 CFU/ml, more typically at least 10 000 CFU/ml. The fibre suspension comprises an aqueous liquid phase and a solid phase comprising recycled fibres. The recycled cellulosic fibres in the fibre suspension may be bleached, unbleached or a mixture bleached and unbleached recycled fibres. The recycled cellulosic fibres in the fibre suspension are non-synthetic natural fibres that have been originally obtained by any mechanical or chemical pulping method or by any combination of mechanical and chemical pulping methods. The recycled cellulosic fibres may be wood and/or non-wood fibres, preferably wood fibres, such as hardwood, softwood or any of their combination. The recycled fibres may originate from any available recycled industrial and/or consumer fibre material. The recycled fibres may originate from, for example, old corrugated containers (OCC), office waste paper, mixed office waste paper, sorted office waste paper or any mixtures thereof. The recycled fibres may originate, for example, from recycled pre-consumer fibre material and/or recycled post-consumer fibre material. The recycled fibres may even be secondary fibres from the production process of paper, board, tissue or the like, such as broke. The amount of recycled cellulosic fibres in the fibre suspension to be treated is at least 60 weigh-%, preferably at least 80 weight-%, more preferably at least 90 weight-% or at least 95 weight-%, calculated from the total dry fibre weight of the suspension. According to one embodiment the cellulosic fibres in the fibre suspension consists of recycled cellulosic fibres.

The aqueous fibre suspension may have an initial bacterial endospore amount of at least 5000 CFU/ml, typically at least 10 000 CFU/ml, more typically at least 15 000 CFU/ml, even more typically at least 20 000 CFU/ml. The initial endospore amount of the fibre suspension comprising recycled cellulosic fibres may be in a range of 1000-500 000 CFU/ml, more typically 10 000-500 000 CFU/ml or 15 000-400 000 CFU/ml, even more typically 20 000-350 000 CFU/ml.

The aqueous fibre suspension has typically an initial oxidation-reduction (ORP) value which is negative, for example, in a range from −500 mV to −50 mV, more typically from −400 mV to −100 mV, even more typically from −300 mV to −200 mV.

According to one embodiment of the invention the fibre suspension may comprise inorganic particles, such as particles of calcium carbonate, kaolin, talc, gypsum or the like. The inorganic particles usually originate from internal fillers, inorganic coatings, labels, stickers or the like, which have been present in the fibre material collected for recycling. The amount of inorganic particles, given as an ash content of the used recycled cellulosic fibre material may be in a range of 5-30 weight-%, usually 5-25 weight-% or 10-20 weight-%. It is normally difficult and/or uneconomical to completely remove the inorganic particles from the recycled cellulosic fibre material during the repulping of the fibre material, which means that usually at least some inorganic particles follow with the recycled cellulosic fibre material to the fibre suspension.

The fibre suspension may usually comprise at least some dissolved carbonate ions.

The fibre consistency of the fibre suspension, at the time of the adjustment of the pH value and/or the ORP value, and/or the introduction of the performic acid, may be at least 1 weight-%, preferably at least 3 weight-%, calculated as dry fibre. According to one embodiment of the invention the fibre consistency of the fibre suspension may be 1-30 weight-%, preferably 3-20 weight-%, more preferably 4-10 weight-%, calculated as dry fibre. According to another embodiment of the invention the fibre consistency of the fibre suspension may be 1-15 weight-%, preferably 2-10 weight-%, more preferably 2-5 weight-%, calculated as dry fibre.

The adjustment of the pH and the ORP value, as well as optionally the introduction of the performic acid, may be made in or after a pulper, or in or after a pulping step where the recycled fibre material is disintegrated and diluted with water, typically to a fibre consistency of 1-5 weight-%, preferably 1-3 weight-%. Alternatively, the adjustment of the pH and the ORP value, as well as optionally the introduction of the performic acid, may be made to a process step or process device where the fibre consistency of the fibre suspension is relatively high, such as 8-30 weight-%, preferably 15-25 weight-%. It is possible that the adjustment of the pH and the ORP values are made at the same fibre consistency or at a different fibre consistency than the introduction of the performic acid, i.e. the fibre suspension may be concentrated or diluted between the different steps of the method, especially between step (b) and step (c).

Usually the fibre suspension formed in the pulper/pulping step comprises, inter alia, hydrophobic contaminants, such as plastics, tapes and/or glue residues. These contaminants, as well as other impurities, large particles, etc., are removed in one or more screening steps following the pulper/pulping step, where contaminants and/or impurities having a size of higher than 200 micrometres are typically removed. According to one embodiment of the invention the adjustment of the pH and the ORP values, as well as optionally the introduction of the performic acid, may be performed after the screening step(s), e.g. in order to optimise the chemical consumption. For example, at least the adjustment of the pH and the ORP value, preferably also the introduction of the performic acid, may be made to a separate mixing tank located after the screening step(s) and before a possible heat disperger or the like.

The fibre suspension is often subjected to fibre fractionation, where the fibres are separated according to their length to at least long fibre fraction and short fibre fraction. According to one embodiment of the invention the adjustment of the pH and the ORP values, as well as optionally the introduction of the performic acid, may be performed after the fractionation step. For example, at least the adjustment of the pH and the ORP value, preferably also the introduction of the performic acid, may be made to at least one, preferably to all fibre fractions, which are obtained from the fibre fractionation and which are used to make a fibre stock.

According to one embodiment of the invention the pH of the fibre suspension is adjusted to a pH value of ≤6.5, preferably by introducing an acidifying agent to the fibre suspension. The pH of the fibre suspension may be adjusted within a pH range of 4-6.5, preferably 4.5-6.5, more preferably 5-6.5, even more preferably 5.5-6.3. Acidifying agent may be any chemical compound suitable for adjusting the pH value of the pulp suspension to a desired level, for example polyaluminium chloride, alum or the like. Acidifying agent may be an organic acid, such as citric acid, formic acid, or the like, or an inorganic acid, such as hydrochloric acid, sulphuric acid, or the like, or a mixture of organic acids and/or inorganic acids. The acidifying agent may be an acidifying gas, such carbon dioxide gas. When the acidifying agent is an acid in liquid form, it is added to the fibre suspension, and when the acidifying agent is in gaseous form, e.g. carbon dioxide gas, it is led into the fibre suspension. The acidifying agent is preferably introduced or added to the fibre suspension in amount that adjusts the pH of the fibre suspension to a desired pH value, without causing a significant increase in the conductivity of the fibre suspension. Effective mixing when the acidifying agent is added to the fibre suspension is advantageous.

Preferably the pH of the fibre suspension is adjusted to a pH value, which is not too acidic, e.g. to a pH ≥4, value preferably ≥4.5, more preferably ≥5. Too acidic pH may lead to dissolution of various components, such as at least some of the inorganic particles, which are present in the fibre suspension, which may lead increase in conductivity and problems later in the manufacturing process of the fibre web. Especially, if the fibre suspension comprises inorganic particles, such as calcium carbonate particles, the pH of the suspension is preferably be adjusted to pH in a range of 5-6.5, more preferably 5.5-6.5, even more preferably 6-6.5. The acidifying agent may be selected on basis of the properties, especially buffering capacity, of the fibre suspension to be treated. For example, fibre suspension with a high buffering capacity, e.g. fibre suspension comprising recycled fibres originating from sorted office waste and with a high calcium carbonate particle content, may be treated with acidifying agent(s) selected from said organic or inorganic acids or their mixtures, in order to obtain economically appropriate consumption of the acidifying agent and to avoid major pH changes which could lead to unwanted changes in conductivity of the fibre suspension.

According to one preferable embodiment the conductivity of the fibre suspension does not significantly change during the reduction of the bacterial endospores in the fibre suspension according to the present method. This means that the fibre suspension usually has an initial conductivity value in a range of 2-10 mS/cm, preferably 2-7 mS/cm, measured before the pH and ORP value adjustment and the introduction of performic acid, and a final conductivity value in the range of 2-10 mS/cm, preferably 3-7 mS/cm, measured after the pH and ORP adjustments and introduction of performic acid. The conductivity of the fibre suspension after the adjustment of the pH and ORP values as well as the addition of the performic acid remains at the level that preferably allows effective performance of the sizing and retention chemicals later in the process of making the final fibre web.

The oxidation-reduction potential (ORP) of the fibre suspension is adjusted to an ORP value of ≥200 mV with a first oxidizing agent, which is added or introduced to the fibre suspension. Preferably the ORP value of the fibre suspension may be adjusted to an ORP value of ≥250 mV, more preferably ≥300 mV. It has been observed that when the ORP value of the fibre suspension is adjusted to the level ≥200 mV, the performic acid is able to effectively eliminate and destroy the bacterial endospores present in the fibre suspension. According to one embodiment the ORP value of the fibre suspension may be adjusted to a range from +100 mV to +500 mV, preferably from +200 mV to +400 mV, more preferably from +300 mV to +400 mV.

The first oxidizing agent for adjustment of the ORP value is different from performic acid, i.e. the first oxidizing agent is not performic acid. Preferably, the used first oxidizing agent is free of performic acid. It is possible that other organic peracids than performic acid can be used as a first oxidizing agent for adjustment of the ORP value. Preferably, however, the first oxidizing agent may be hydrogen peroxide, $H_2O_2$, or a percarbonate salt, preferably sodium percarbonate. Hydrogen peroxide and percarbonate salts are readily available in industrial scale and they are able to effectively adjust the ORP value of the fibre suspension to the desired level. The first oxidizing agent may be considered as a sacrificial treatment agent, with which the consumption of performic acid may be kept as low as possible. The use of first oxidizing agent does provide effective means for adjusting the ORP value to a level, where the full potential of the performic acid can be realised.

The first oxidizing agent may be introduced to the fibre suspension in amount that provides the desired ORP value for the fibre suspension comprising recycled cellulosic fibres. According to one embodiment of the invention, the first oxidizing agent may be introduced to the fibre suspension in amount of 300-1000 ppm, preferably 400-800 ppm, preferably 500-700 ppm, given as grams active agent per ton fibre suspension.

The addition of the first oxidizing agent to the fibre suspension does not provide a bleaching effect for the fibre suspension. This means that the ISO brightness of the fibre suspension does not significantly change after the addition of the first oxidizing agent. In general, the change in ISO brightness of the fibre suspension, if any at all, is less than 5 ISO %, preferably less than 3 ISO %, more preferably less than 1 ISO %, measured by using standard ISO 2470-1: 2016.

According to the present invention the performic acid as the second oxidizing agent is introduced, i.e. added, to the fibre suspension in amount that reduces the bacterial endospore amount to ≤1000 CFU/ml, preferably ≤500 CFU/ml, more preferably ≤250 CFU/ml, even more preferably ≤150 CFU/ml, sometimes even ≤100 CFU/ml, for the treated fibre suspension. According to one embodiment of the invention, the performic acid may be introduced to the fibre suspension in amount that reduces the bacterial endospore amount to ≤50 CFU/ml, even to ≤30 CFU/ml or even ≤10 CFU/ml. The performic acid may be introduced, i.e. added, to the fibre suspension in amount of 50-500 ppm, preferably 100-400 ppm, preferably 200-300 ppm, given as grams active agent per ton fibre suspension. Bacterial endospore amounts can be determined by using conventional techniques, known as such for a person skilled in the art.

Performic acid, $CH_2O_3$, is introduced to the fibre suspension as an aqueous solution. Performic acid may be prepared by mixing an aqueous hydrogen peroxide solution with an aqueous solution of formic acid, and optionally a catalyst, e.g. sulfuric acid. Preferably the aqueous performic acid solution is used as an equilibrium solution comprising performic acid, formic acid, water, hydrogen peroxide and optionally a catalyst. Performic acid solution has typically a concentration at least 10%, calculated as weight to volume, typically around 13.5% or 14% of performic acid, calculated as weight to volume.

Performic acid is preferably allowed to interact with the bacterial endospores in the fibre suspension at an elevated fibre suspension temperature. According to one embodiment of the temperature of the fibre suspension may be at least 50° C., preferably at least 60° C. or sometimes even at least 70° C. The temperature of the fibre suspension may preferably be <100° C., more preferably <85° C., even more preferably <75° C. Especially, when the pH of the fibre suspension is adjusted in the range of 5.5-6.5, it is advantageous if the temperature of the fibre suspension is in a range of 30-120° C., preferably 30-99° C., more preferably 50-80° C., even more preferably 60-80° C., when the performic acid is introduced to fibre suspension and/or when the performic acid is interacting with the bacterial endospores. It has been observed that in this manner the maximal endospore destructive effect may be achieved. It is assumed, without wishing to be bound by any theory, that the elevated temperature may further sensitize the bacterial endospores and make them receptive for the destroying action when the performic acid is introduced to the fibre suspension. It is advantageous that the effective endospore reduction or destruction can be obtained already at fibre suspension temperatures below 100° C. Expensive and complicated process devices, such as pressurised heat steam treatment tanks, can be thus avoided.

The temperature of the fibre suspension may be increased to the desired value by heating the fibre suspension to the desired temperature in a separate process step. For example, the fibre suspension may be transferred to a separate tank, located after the pulper, preferably after the screening step(s). In the separate tank the fibre suspension may be heated to the desired temperature. Alternatively, the pH adjustment, the ORP value adjustment and/or at least the performic acid introduction may be performed in a process stage, where the temperature of the fibre suspension is at the desired level. An example of a process stage, possibly a process step in a RCF mill, may be, for example, dispersion of the recycled fibre suspension in a heat disperger. Heat dispergers are commercially available and conventionally employed in the pulping processes of recycled fibres for disintegration of stickies and dirt homogenization. It is possible that the temperature of the fibre suspension is adjusted on a desired level shortly or immediately after the introduction of the performic acid to the fibre suspension. For example, the performic acid introduction may be performed immediately before the fibre suspension is predewatered, heated and disperged in the heat disperger. It is also possible that the performic acid is introduced to the fibre suspension at the same time when the fibre suspension is heated to the desired temperature, e.g. in a heat disperger. Fibre suspension consistency at the inlet of the heat disperger may be 20-40 weight-%, calculated as dry fibre, and the temperature of the fibre suspension in a disperger may be 60-120° C.

Preferably the temperature of the fibre suspension is adjusted to the elevated temperature as specified above, before the performic acid is introduced to the fibre suspension.

It is also possible that the adjustment of the pH and the ORP value, as well as the introduction of the performic acid can be made to the fibre suspension in a separate tank, located immediately after the disperger. The fibre suspension may be even heated to the desired temperature in the same separate tank.

According to one embodiment the adjustment of the pH and the ORP values, optionally also the introduction of the performic acid may be made to the fibre suspension in a separate tank, such as storage tank or like, where a fibre suspension, which is used to make a fibre stock, is stored. The fibre suspension may comprise or consist of recycled fibres or, for example, fibres obtained by mechanical pulping.

In case the pH of the fibre suspension is within a pH range of 4-5.5, preferably 4.3-5, even a lower temperature of the fibre suspension, such as 25-60° C., preferably 30-55° C., more preferably 35-55° C., may suffice. It is assumed, without wishing to be bound by any theory, that the lower pH may sensitize the bacterial endospores in a similar manner than the elevated temperature and make them receptive for the destroying action of the performic acid.

According to one embodiment of the invention, after the treatment of the fibre suspension with the performic acid at least a part of the aqueous liquid phase of the fibre suspension is separated from the solid phase of the fibre suspension comprising the recycled cellulosic fibres and the separated aqueous liquid phase is recycled back in the process and reused for formation of the initial fibre suspension.

The separated aqueous phase typically comprises a base concentration of unconsumed first and/or second oxidizing agent. This means that recirculation of the aqueous phase in the method provides a possibility to reduce the amount of the first and/or second oxidizing agent which is needed for adjustment of the ORP value to the desired level and for the destruction or reduction of bacterial endospores.

After the performic acid have been allowed to interact with the fibre suspension and the amount of bacterial endospores in the fibre suspension is reduced, the pH of the fibre suspension may be adjusted, e.g. neutralised, to a desired value by using a strong base, e.g. NaOH, or sodium bisulphite, if need be. Usually the neutralisation is performed after a suitable treatment or interaction time has elapsed after the introduction of the performic acid. The treatment time which is needed for the interaction between the performic acid and the bacterial endospores may be, for example, 15 min or 30 min.

The present invention is suitable for use in any manufacturing process where a cellulosic fibre web is produced from recycled fibres, such as manufacturing process of paper, board, tissue or the like. The present invention is suitable, among others, for manufacturing of moulded pulp products. The present method is especially suitable for reducing bacterial endospore amount in a fibre suspension containing recycled cellulosic fibres and intended for production of liquid packaging board, food packaging board and the like.

According to one preferable embodiment of the present invention, the after the introduction, i.e. addition, of the performic acid, the treated fibre suspension may be used to make a fibre stock, which is formed into a fibre web or a fibre layer in a multilayer fibre web. The fibre suspension may be diluted with water to a suitable consistency for forming the fibre stock and for forming the fibre web or the fibre layer. The fibre stock may also be used for manufacturing of moulded pulp products. The fibre stock may comprise any commonly used chemicals, such as retention agent(s), internal sizing agent(s), wet strength and/or dry strength agents, etc., commonly used in making of fibre webs, such as paper, board, tissue and the like.

In addition to the recycled fibres, the fibre stock may also comprise virgin fibres. Preferably, the fibre stock comprises at least 10 weight-%, preferably at least 20 weight-%, more preferably at least 30 weight-% or at least 50 weight-%, of fibre suspension comprising recycled cellulosic fibres and treated according to the method of the present invention.

Preferably the total bacterial endospore amount in the formed fibre web or the multilayer fibre web may be <5000 CFU/g of dry fibrous web, preferably <2500 CFU/g of dry fibrous web, more preferably <1000 CFU/g dry fibre web, preferably <500 CFU/g dry fibre web, even more preferably <250 CFU/g dry fibre web.

According to one preferable embodiment of the invention the method is used for production of food and/or liquid packing grade paper or board. Typically, the grammage of the packaging grade board may be 150-400 g/m$^2$, preferably 200-360 g/m$^2$, more preferably 240-300 g/m$^2$. The paper and board grades for food and/or liquid packaging may be polymer coated or foil-laminated for barrier properties. Suitable polymers for coating are, e.g. polyolefins, such as polyethylene or polypropylene; polyvinyl alcohol; polyvinylamine; polyethylene terephthalate; polybutylene terephthalate.

EXPERIMENTAL

Example 1

Example 1 is a laboratory test which studies the kill effect of performic acid against bacterial endospores in recycled fibre pulp sample, at adjusted pH and oxidation-reduction potential, ORP.

14% of performic acid, calculated as weight to volume, was used in Example 1, as pre-formed conventional equilibrium solution of performic acid, formic acid, water and hydrogen peroxide.

1 litre of authentic recycled fibre (RCF) pulp was collected from a RCF mill producing packaging board using sorted office paper RCF pulp. The RCF pulp sample had a consistency of 4.4 weight-%, pH 6.3, initial ORP value −431 mV.

The collected RCF sample was divided into 6 subsamples, each with volume of 100 ml. Subsamples 1, 2, 3 were warmed up to +30° C. by keeping them at 30° C. water bath for 45 minutes. Subsamples 4, 5, 6 were warmed to +80° C. by keeping them at 80° C. water bath for 45 minutes.

pH was decreased to pH <6.0 in subsamples 2, 3, 5 and 6. In subsamples 2 and 5 the pH adjustment was made with polyaluminium chloride (PAC as 1600 ppm active) and in subsamples 3 and 6 with 10% citric acid (as 100 ppm as active).

After pH adjustment, the subsamples 2, 3, 5 and 6 were treated with hydrogen peroxide (as 600 ppm as active) and with performic acid (14% PFA, as 200 ppm as active).

Subsamples 1 and 4 were left without any chemical treatments, functioning as reference samples.

pH, ORP value and conductivity measurements, as well as bacterial endospores quantitation (plate count agar, +32° C., 2 days incubation) were performed for all samples. For subsamples 2, 3, 5 and 6 the measurements and endospore quantitation were performed after the chemical treatments. Prior to the aerobic spore determination, samples were pasteurised at +82° C. for 10 min.

Results for Example 1 are shown in Table 1.

Obtained results in Table 1 show that the bacterial endospore amount in the chemically untreated reference subsamples 1 and 4 was very high, 200 000 CFU/ml or 500 000 CFU/ml, and the ORP value very low, −431 mV or −227 mV, irrespective is the subsample was kept at 30° C. or at 80° C. It is seen that the chemical treatment with PAC/Citric acid+$H_2O_2$+PFA strongly increase the final ORP value, up to a level higher than +300 mV, and markedly decreased by 1-4 logs the bacterial endospore amount, after 45 min contact at +30° C. and at +80° C. Furthermore, it is seen from the results for subsamples 3 and 6 that the chemical treatment including citric acid for pH adjustment results only minor a change in conductivity.

Example 1 shows that an effective endospore killing effect is obtained at +80° C. with chemical treatment including citric acid, $H_2O_2$ and PFA. This chemical treatment decreased level of bacterial endospores from 200 000 spores/ml down to 10 spores/ml, without any significant change in conductivity of the fibre suspension. Obtained results thus clearly indicate that chemical treatment including pH and ORP adjustment with the use of performic acid may effectively be employed to reduce the amount of bacterial endospores in highly reductive RCF fibre suspensions, without markedly changing pulp conductivity. This may eventually help RCF mills to target production of hygienic board grades, where bacterial endospores content in the final board is a critical hygienic criterium.

TABLE 1

Results for Example 1.

| Sub-sample | Treatment Temperature, ° C. | Chemical Treatment | Aerobic Spores, (CFU/ml) | pH | ORP, mV | Conductivity, mS/cm |
|---|---|---|---|---|---|---|
| 1 (Ref.) | +30 | — | 500 000 | 6.3 | −431 | 3.6 |
| 2 | +30 | 1600 ppm PAC + 600 ppm $H_2O_2$ + 200 ppm PFA | 10 000 | 5.8 | 332 | 6.3 |
| 3 | +30 | 100 ppm citric acid + 600 ppm $H_2O_2$ + 200 ppm PFA | 7 000 | 5.9 | 361 | 4.5 |
| 4 (Ref.) | +80 | — | 200 000 | 6.4 | −227 | 4.2 |
| 5 | +80 | 1600 ppm PAC + 600 ppm $H_2O_2$ + 200 ppm PFA | 170 | 5.6 | 314 | 11.4 |
| 6 | +80 | 100 ppm citric acid + 600 ppm $H_2O_2$ + 200 ppm PFA | 10 | 5.7 | 313 | 5.0 |

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A method for reducing bacterial endospores in an aqueous fibre suspension comprising recycled cellulosic fibres, wherein the fibre suspension has an original bacterial endospore amount, the method comprising (a) adjusting pH of the fibre suspension to a pH value of ≤6.5, (b) adjusting oxidation-reduction potential (ORP) of the fibre suspension to an ORP value of ≥200 mV with a first oxidizing agent, and (c) introducing an amount of performic acid as a second oxidizing agent to the fibre suspension for reducing the original bacterial endospore amount to an endospore amount of ≤1000 CFU/ml.

2. The method according to claim 1, wherein the fibre suspension comprises inorganic particles, and that the pH of the fibre suspension is adjusted to a range of 5-6.5.

3. The method according to claim 1, wherein the pH of the fibre suspension is adjusted by introducing an acidifying agent to the fibre suspension.

4. The method according to claim 1, wherein the temperature of the fibre suspension is at least 50° C.

5. The method according to claim 1, wherein the fibre suspension has a final conductivity value, measured after the adjustment of pH and the ORP value, in a range of 2-10 mS/cm.

6. The method according to claim 1, wherein the first oxidizing agent is $H_2O_2$ or a percarbonate salt.

7. The method according to claim 1, wherein the ORP value is adjusted to a range from +200 m V to +400 mV.

8. The method according to claim 1, wherein the performic acid is introduced to the fibre suspension in an amount that reduces the endospore amount to ≤500 CFU/ml.

9. The method according to claim 1, wherein the first oxidizing agent is introduced to the fibre suspension in an amount of 300-1000 ppm, given as grams active agent per ton fibre suspension.

10. The method according to claim 1, wherein the performic acid as the second oxidizing agent is introduced to the fibre suspension in an amount of 50-500 ppm, given as grams active agent per ton fibre suspension.

11. The method according to claim 1, wherein the adjustment of the pH and the ORP values, optionally also the introduction of the performic acid, are made in a pulper or after a pulper.

12. The method according to claim 1, wherein the adjustment of the pH and the ORP value, optionally also the introduction of the performic acid, are made in a process step or a process device where the fibre suspension has a consistency of 8-30 weight-%.

13. The method according to claim 1, wherein after the bacterial endospore amount of the fibre suspension is reduced to ≤1000 CFU/ml, the fibre suspension is used to make a fibre stock, which is formed into a fibrous web or a fibrous layer in a multilayer fibrous web.

14. The method according to claim 13, wherein the bacterial endospore amount in the formed fibrous web or the multilayer fibrous web is <5000 CFU/g of dry fibrous web.

15. The method according to claim 13, wherein the fibre stock comprises at least 10 weight-% of said fibre suspension.

16. The method according to claim 1, wherein the fibre suspension has the original bacterial endospore amount of ≥10 000 CFU/ml.

* * * * *